US005377912A

United States Patent [19]

Webb

[11] Patent Number: 5,377,912

[45] Date of Patent: Jan. 3, 1995

[54] PERSONALIZED FIRE RETARDANT DISPENSING SYSTEM

[76] Inventor: James Webb, 877 Avenue B, Redondo Beach, Calif. 90277

[21] Appl. No.: 192,450

[22] Filed: Feb. 7, 1994

[51] Int. Cl.[6] ..... A62C 3/00; B05B 9/08

[52] U.S. Cl. ..... 239/154; 239/152; 239/75; 222/175; 169/52

[58] Field of Search ..... 239/67, 75, 152–154, 239/289; 222/175, 192; 169/52, 50, 49, 48

[56] References Cited

U.S. PATENT DOCUMENTS

| | | | |
|---|---|---|---|
| 1,244,637 | 10/1917 | O'Loughlin | 169/48 |
| 2,632,163 | 3/1953 | Spandau | 169/48 X |
| 2,761,515 | 9/1956 | Feild, Jr. et al. | 169/48 X |
| 3,223,172 | 12/1965 | Moss | 239/152 X |
| 3,352,364 | 11/1967 | De Coste | 239/152 X |
| 5,104,016 | 4/1992 | Runkel | 222/175 X |
| 5,148,950 | 9/1992 | Hosaka | 222/175 |

FOREIGN PATENT DOCUMENTS

| | | | |
|---|---|---|---|
| 893003 | 2/1972 | Canada | 222/175 |
| 7668 | of 1888 | United Kingdom | 239/289 |

*Primary Examiner*—Andres Kashnikow
*Assistant Examiner*—Lesley D. Morris
*Attorney, Agent, or Firm*—Roger A. Marrs

[57] ABSTRACT

A fire retardant dispensing device is disclosed intended to be worn about the head within the helmet of a driver, which includes an apertured dispensing ring secured to the helmet about critical facial areas and operatively coupled to a pressurized source or reservoir of fire retardant. The dispensing ring includes a pair of lateral nozzles supplementing discharge and distribution of the fire retardant from the apertured ring. A buckled belt releasably retains the fire retardant source about the torso or leg of the user.

6 Claims, 1 Drawing Sheet

PERSONALIZED FIRE RETARDANT DISPENSING SYSTEM

BACKGROUND OF THE INVENTION

1. Field of the Invention

The present invention relates to the field of fire extinguishers, and more particularly to a novel personalized fire retardant dispensing apparatus which is worn by the user and includes dispensing means for distributing a fire retardant about the head and upper body region of the user when exposed to a high temperature fire environment.

2. Brief Description of the Prior Art

In the past, many persons engaging in sports events, such as race car drivers, were exposed to a fire environment during a crash or explosion encountered in the performance of a sporting event. Although the driver may be covered by fire resistant gloves, driving suit and a helmet, certain critical areas are exposed to the heat and flame of the environment wherein such areas include the eyes, face, ears and neck. The racing vehicle may include a fire extinguishing system in the cockpit or driving area of the vehicle which may automatically cover the external suit, gloves and helmet of the driver with a fire extinguishing or retardant agent. However, this procedure still leaves the critical areas exposed within the helmet and does not provide for "fire creep" which consumes oxygen within the helmet and does not protect against inhalation of flame.

Therefore, a long-standing need has existed to provide an instant deluge spray dispensing system for a fire extinguishing or retardant which will assist a person in avoidance of fire distinguishment and permanent injury. Such a system should stay with the driver as the driver may exit a race car and preferably should include automatic features such as temperature actuated as well as manual commencement of the dispensing agent. Protection must be available against inhalation of flame and the system should allow "open eye" exit of the vehicle in a fire situation.

Furthermore, a fire retardant medium is to be breathable to allow oxygen supplementation or non-toxic inhalation for life sustenance as well as functioning as a fire retarding substance.

SUMMARY OF THE INVENTION

Accordingly, the above problems and difficulties are avoided by the present invention which provides a novel dispensing system for a pre-stored fire retardant or extinguishing agent which includes an annular ring having a plurality of jets in spaced relationship adapted to discharge the fire extinguishing or retardant agent in a downward direction. Means are provided for retaining-the annular ring on the interior of a helmet worn by the user so that the discharge is adjacent to critical facial areas, such as the eyes, nose, ears and neck. The ring further includes a pair of spaced-apart jets which are raised above the ring so that the discharge therefrom will be about the upper interior section of the helmet. A pressurized source of the fire extinguishing or retardant agent is carried on a strap or belt so that the system is completely carried on the person of the user and is adapted to travel therewith. Temperature activated means are operably connected in the source of fire extinguishing or retardant agent which automatically actuates the system upon attainment of a temperature level within the ambient environment of the user. A conduit interconnects the source of fire extinguishing or retardant agent with the annular ring and a disconnect means is provided in the conduit for selectively separating the conduit at the desire of the user.

Therefore, it is among the primary objects of the present invention to provide a novel instant deluge spray dispensing system for a fire extinguishing or retardant agent that is carried on the person of the user and which operates in combination with a helmet to protect the exposed and critical areas of the face, such as eyes, face, ears and neck during exposure to a heated and flame environment.

Another object of the present invention is to provide a novel fire extinguishing and retardant dispensing system which includes an automatic temperature activated means as well as a manual means for initiation of the dispensing of the agent, particularly in the instance of the user being unconscious.

Yet another object of the present invention is to provide a novel fire extinguishing system which is carried on the user's person and stays with the person as the person moves about and which disallows "fire creep" to oxygen areas inside the helmet worn by the user and which will also protect against inhalation of flame.

Another object of the present invention is to provide a novel fire extinguishing system which allows "open eye" exit from the vehicle by the user in a fire situation wherein the system is carried on the person of the user so that an extreme comfort level for the user is provided.

Yet another object of the present invention resides in the provision of a fire extinguishing or retardation system which permits the user to wear the system in combination with his clothing so that the user is unimpeded and is unencumbered by the system.

Yet another object is to supply the helmet cavity with a fire retarding composition that is breathable and non-toxic, therefore displacing smoke or combustible fire from the lungs and head cavity area, further allowing safe exit and consciousness.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
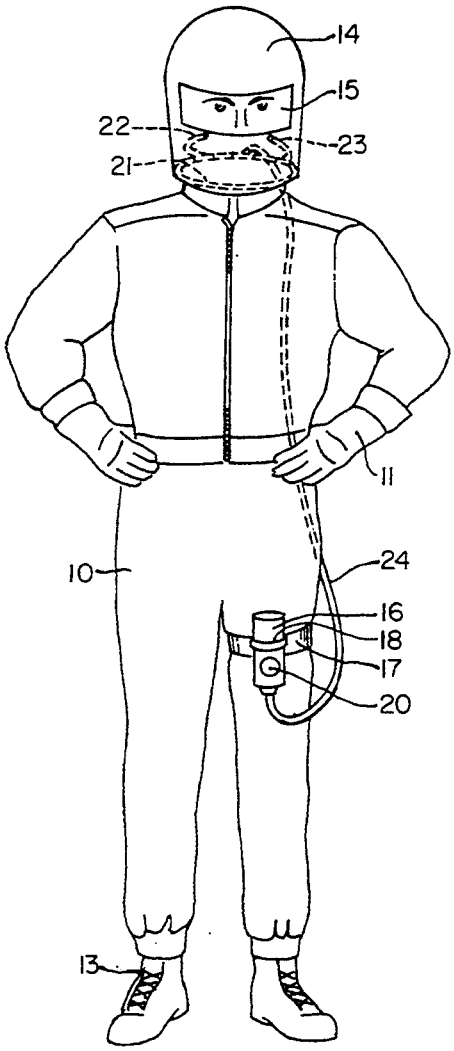
FIG. 1 is a front elevational view of a person on which the novel fire extinguishing and retardant agent dispensing system is worn.

Referring to FIG. 1, a person is identified by numeral 10 who is illustrated as a race car driver having a fire resistant or retardant suit covering substantially the torso, arms and legs. The suit is broadly illustrated and,-the person's hands are covered by gloves 11 and his feet by boots 13. The person's head is contained within a helmet 14. As is the conventional practice, the helmet 14 is provided with a window 15 through which the user can view externally of the helmet.

In accordance with the present invention, the fire extinguishing or retardant agent dispensing system includes a reservoir 16 or source of agent which is pressurized at a high PSI and takes the form of a cannister which may be strapped to the leg of the user by means of a strap 17. The cannister includes an attachment ring 18 so that the cannister is detachably connected to the strap 17. A manual actuating means is indicated by numeral 20 so that the system may be put into operation at the will of the user. Also, within the switch means 20, there is provided a temperature sensing means adapted to initiate operation of the system when a preselected temperature has been reached.

An apertured dispensing ring 21 is included in the system which may be attached to the interior of the helmet by any suitable means and preferably, at the base of the helmet so that the ring is adjacent to the neck of the wearer. Normally, the base of the helmet is open and is disposed loosely above the collar of the user's suit so that fumes, flame and other irritants in the environment may enter the helmet and disturb the vision and comfort of the user. In some instances, flame and heat will cause harm to the critical facial areas. The apertured dispensing ring 21 further includes additional jets 22 and 23 which may be directed to dispense the extinguishing or retardant agent about the upper head of the user.

The cannister 16 carrying the agent in high pressure is connected to the dispensing ring 21 means of conduit or tube 24. Therefore, upon actuation of the switch means 20 by either manual or heat sensitive means, the pressurized agent will be conducted to the dispensing ring 21 via the tube or hose 24 and the agent will be distributed throughout the interior of the helmet by means of the nozzles 22 and 23 and the apertures in the ring 21. Primarily, the jets and apertures are adjacent the face frontal area and will dispense the agent at the lower end or bottom of the helmet and from the sides so as to avoid helmet restriction. The ring and the jets are close to the interior surface of the helmet so that the user is not restricted in head movement or in rapidly placing the helmet over his head or taking it therefrom.

Figure 2:
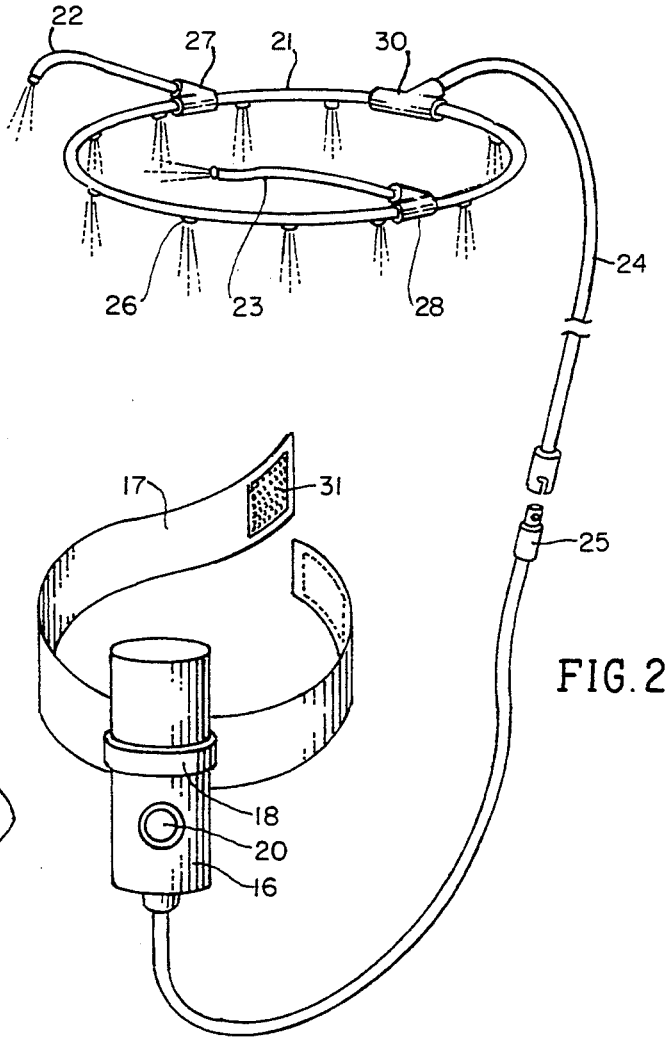
FIG. 2 is a perspective view of the novel dispensing system shown in FIG. 1.

Referring now in detail to FIG. 2, it can be seen that the hose or tube 24 is flexible and includes a rapid disconnect means taking the form of a bayonet type socket arrangement and broadly indicated by numeral 25. The aperture ring 21 is illustrated as having a plurality of apertures which may include jets, such as jet 26, for discharging the agent, as previously described. The agent is also discharged via the jets 22 and 23 in different directions from the direction dispensing the agent from ring 21. Suitable connectors, such as connector 27 and 28, couple the jets 22 and 23 to the main dispensing ring while a T-connector 30 couples the hose 24 with the ring 21. There are no connectors shown in FIG. 2 for attaching to the helmet 14; however, it is to be understood that such connectors are conventional and that the helmet may also be in molded relationship with the ring 21 as desired. Also, it can be seen that the leg strap 17 includes a hook and pile fastener, illustrated by numeral 31, so that the strap holding the cannister 16 may be readily attached and detached from the user's leg.

Figure 3:
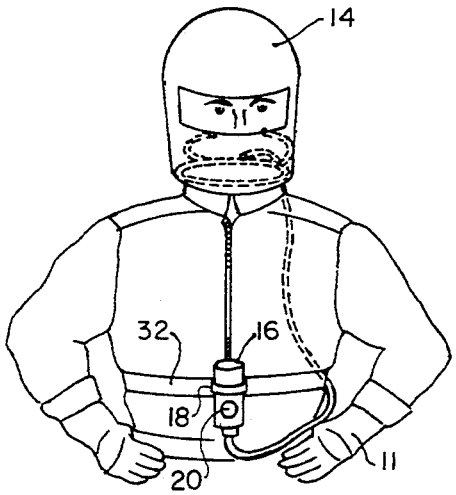
FIG. 3 is an alternate view of the dispensing system illustrating a variation in the wear of the dispensing system.

Referring now to FIG. 3, it can be seen that the system of the present invention can be attached to the torso or waist of the user by a belt 32 and that the attachment ring 18 and cannister 16 may be carried at this level on the user's body. The use of either a waist belt or a leg strap is at the discretion of the user and it depends largely upon his orientation within the cockpit or driver's compartment of the vehicle.

In view of the foregoing, it can be seen that the novel system of the present invention provides an instant deluge of a spray within the confines of the helmet 14 so that driver safety is obtained in avoidance of fire disfigurement and permanent injury to the driver. The jets of the ring 21, as well as of the additional jets 22 and 23, are included into an integrated tubular plumbing system within the construction of the helmet and the fire retardant is contained within cannister 16 which is of high PSI. The novel dispensing system stays with the driver even upon exit of the user from the vehicle itself and the actuation of the system is either manual or temperature actuated so that it is automatic in case of the user being unconscious. The system protects exposed and crucial areas, such as the eyes, face and ears, as well as the neck of the user, and the system disallows "fire creep" to oxygen areas inside the helmet. The system protects against inhalation of flame and allows "open eye" exit of the vehicle in fire situations, as well as providing extreme comfort for the driver. The system is non-obstructive and does not interfere or restrict movement or operation procedures by the user and allows a safety margin of time for the user's helmet removal and exit from the vehicle.

It is to be noted that the fire retardant medium may be breathable so as to permit oxygen supplementation or non-toxic inhalation for life sustenance as well as functioning as a fire retarding substance. Such a medium may be a gas identified as INTERGEN which is manufactured by Ansul Corporation, 1 Stanton St., Marinette, Wis. 54143.

The inventive concept further includes, if desired, a portable, lightweight bag and tank for convenience in carrying in airplanes, for use in high-rise buildings, etc. This provision allows a person to surround his head within the sack or bag as an enclosure and to activate the fire retardant medium such as the gas. Thus, the person is enabled to breathe and to see his way to safety. The helmet, bag or sack as an enclosure pressurizes the facial area to inhibit the possibility of smoke inhalation.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A personalized and portable fire retardant dispensing system comprising:

a head enclosure adapted to be worn by the user;

a supply of pressurized fire retardant substance carried on the user remote from said head enclosure;

a fire retardant substance distribution means interconnecting said supply with the interior of said head enclosure;

activation means carried on said supply for selectively providing fire retardant substance to said head enclosure via said distribution means;

said distribution system includes a dispensing ring disposed within said head enclosure and an elongated hose connected between said supply and said dispensing ring;

a plurality of jets carried on said dispensing ring for discharging said fire retardant substance within said head enclosure; and at least two discharge tubes carried on said dispensing ring for directional discharging fire retardant substance in a direction other than the direction of discharge by said jets.

2. The invention as defined in claim 1 including:

strap means releasably securing said supply to the user.

3. The invention as defined in claim 2 wherein:

said elongated hose is two sections having a coupling releasably attaching opposing ends of said two sections.

4. The invention as defined in claim 3 wherein:

said head enclosure includes a window allowing visual observation exteriorly of said head enclosure.

5. A personalized and portable fire retardant dispensing system comprising:

a head enclosure to be worn by a user;

a supply of pressurized fire retardant substance carried on the user remote from said head enclosure;

a fire retardant substance distribution means interconnecting said supply with the interior of said head enclosure;

activation means carried on said supply for selectively providing fire retardant substance to said head enclosure via said distribution means;

wherein said fire retardant substance is INTERGEN, a breathable non-toxic gas for inhalation by the user;

and wherein said distribution means includes a tubular ring coupled to said supply and having a plurality of jets discharging the fire retardant substance in a downward direction and further having pliable tubes with one end thereof connected to said ring and the other end thereof directing discharge of fire retardant substance in a direction other than said jets' discharging direction.

6. The invention as defined in claim 5 wherein:

said jets discharge fire retardant substance about the neck of the user and said tubes discharge fire retardant substance about the facial area of the user.

* * * * *

UNITED STATES PATENT AND TRADEMARK OFFICE

CERTIFICATE OF CORRECTION

PATENT NO. : 5,377,912

DATED : December 27,1994

INVENTOR(S) : William L. Brown Et Al

It is certified that error appears in the above-identified patent and that said Letters Patent is hereby corrected as shown below:

In Claim 47, column 17, line 1, "ration" should be --ratio--.

Signed and Sealed this

Sixteenth Day of May, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,377,912

DATED : January 3, 1995

INVENTOR(S) : James Webb

It is certified that error appears in the above-identified patent and that said Letters Patent is hereby corrected as shown below:

This certificate supersedes Certificate of Correction issued May 16, 1995, the number should be deleted since no Certificate of Correction should have been issued.

Signed and Sealed this

Twenty-third Day of May, 2000

*Attest:*

Q. TODD DICKINSON

*Attesting Officer*

*Director of Patents and Trademarks*